United States Patent [19]

Bullock

[11] 4,065,253

[45] Dec. 27, 1977

[54] LAUNDRY DRYER

[75] Inventor: Norman J. Bullock, Prospect, Ky.

[73] Assignee: W. M. Cissell Manufacturing Company, Louisville, Ky.

[21] Appl. No.: 716,185

[22] Filed: Aug. 20, 1976

[51] Int. Cl.[2] ..... F27B 7/36

[52] U.S. Cl. ..... 432/105; 34/86; 34/133

[58] Field of Search ..... 432/105, 107, 103; 34/35, 86, 131, 132, 133, 139

[56] References Cited

U.S. PATENT DOCUMENTS

| | | | |
|---|---|---|---|
| 3,290,028 | 12/1966 | Kruzan | 432/105 |
| 3,483,632 | 12/1969 | Triplett | 34/133 |
| 3,959,892 | 6/1976 | Cloud et al. | 34/133 |
| 3,969,070 | 7/1976 | Thompson | 432/105 |
| 3,995,988 | 12/1976 | Freze | 432/105 |

*Primary Examiner*—John J. Camby
*Assistant Examiner*—Henry C. Yuen

[57] ABSTRACT

A laundry dryer structured to recirculate and reheat a portion of the warm exhaust air, and admix same with newly heated make-up air. A novel hot air compartment positioned within the dryer's housing includes a heat transfer air duct disposed immediately above, and as a part of, a heat transfer chamber. The heat transfer chamber includes a roof above a heat source, that roof comprising the floor of the heat transfer air duct and that roof being heated by the heat source. Recirculated air is directed over the exterior surface of the heat transfer air duct (which is heated by reason of its being proximate to and a part of the heat transfer chamber), and thereafter is directed through the heat transfer air duct. The make-up air heated in the heat transfer chamber exhausts from a port in that chamber's roof into admixed flow with the already preheated, recirculated air as the recirculated air passes through the heat transfer air duct. The compartment also includes a feed duct adapted to direct the admixed recirculated air and make-up air, after same has been heated to the required temperature level, into the rotating drum of the dryer. This structure serves to reheat the recirculated air, as well as to heat initially the make-up air, without directly contacting the recirculated air with the heat source.

5 Claims, 4 Drawing Figures

LAUNDRY DRYER

This application relates to laundry dryers. More particularly, this invention relates to a novel laundry dryer structure in which a portion of the warm exhaust air is recirculated through the drying chamber.

Laundry dryers are, of course, very well known to the prior art, and have been in use for many years. All laundry dryers are provided with a heat source. The heat source functions to elevate the temperature of make-up air so that same can dry laundry, e.g., clothes or the like, as that heated make-up air is passed through the rotating tumbler or drum within the dryer's housing. The heat source may be fueled by either electricity, gas, or steam. However, the heat source is commonly in the form of gas fired burners in commercial laundry dryer establishments, or in industrial type laundry dryers.

The cost of fueling a laundry dryer of the commercial or industrial type is quite substantial. This is particularly the case with gas fired dryers, such gas fired dryers being the common type used in commercial and industrial applications as previously mentioned. In recent years the cost of natural and liquid petroleum gas fuel has risen substantially, and this has substantially increased the operating cost to the dryer owner. Further, in recent years it has become good business practice to conserve as much natural resource energy as is possible. However, a dryer is, by its nature, an energy wasting device as the hot air generated has heretofore, in common commercial practice, made only a single pass through the laundry dryer's drum before same is exhausted to atmosphere.

It is known to the prior art to recirculate a portion of the warm air generated and used in the drying of laundry within a laundry dryer. In other words, it is known to recirculate a portion of a dryer's warm exhaust air back through the dryer's drum to aid in the laundry drying process. There are various types of warm air recirculation systems known to the prior art. One such warm air recirculation system for laundry dryers is that illustrated in U.S. Pat. No. 3,157,391.

It has been the objective of this invention, therefore, to provide an improved and novel warm air recirculation system for a laundry dryer. In accord with this objective, this invention contemplates a unique hot air compartment that reheats recirculated warm exhaust air, heats new make-up air apart from the warm exhaust air, and admixes those two air flows with one of another after the heat up of each prior to introduction with the dryer's drum. The hot air compartment structure employed to carry out this objective is positioned above the dryer's tumbler within the dryer's housing. The novel hot air compartment includes a heat transfer air duct disposed immediately above, and as a part of, a heat transfer chamber. The heat transfer chamber includes a roof above a heat source, that roof comprising the floor of the heat transfer air duct and that roof being heated by the heat source. Recirculated air is directed over the exterior surface of the heat transfer air duct (which is heated by reason of its being proximate to and a part of the heat transfer chamber), and thereafter is directed through the heat transfer air duct. The make-up air heated in the heat transfer chamber exhausts from a port in that chamber's roof into admixed flow with the already preheated, recirculated air as the recirculated air passes through the heat transfer air duct. The compartment also includes a feed duct adapted to direct the admixed recirculated air and make-up air, after same has been heated to the required temperature level, into the rotating drum of the dryer. This structure serves to reheat the recirculated air, as well as to heat initially the make-up air, without directly contacting the recirculated air with the heat source. Direct contact of the recirculated air, which may contain some lint therein, is not desirable from a safety or heat transfer efficiency standpoint, particularly if that heat source is an open gas flame as is commonly used in commercial or industrial gas fired dryers.

Other objectives and advantages of this invention will be more apparent from the following detailed description taken in conjunction with the drawings in which.

Figure 1:
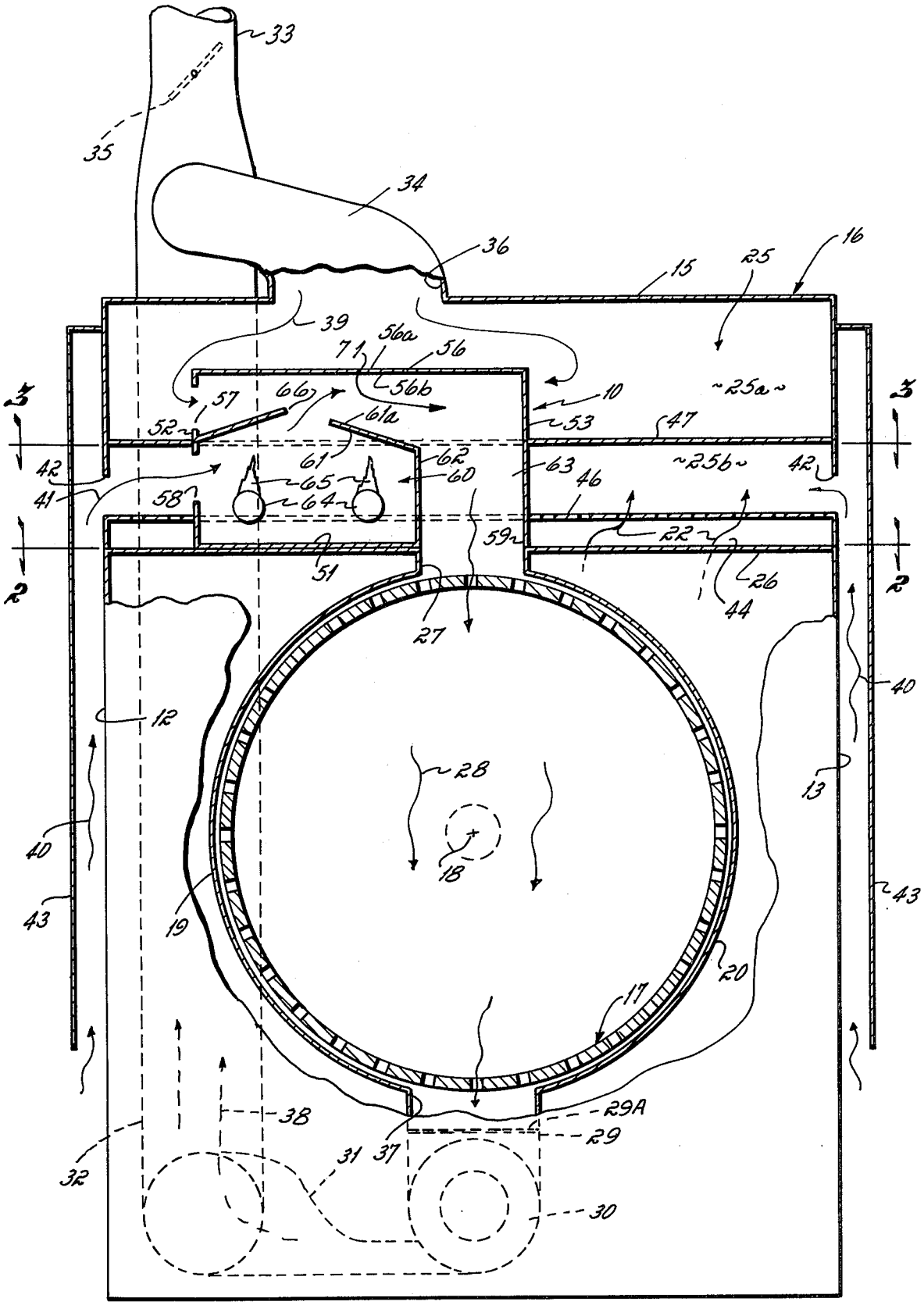
FIG. 1 is a partially broken away front view of a laundry dryer structured in accord with the principles of this invention.

A laundry dryer incorporating the novel hot air compartment 10 of this invention includes front wall 11, side walls 12, 13, rear wall 14, and roof 15, all connected together in known fashion to form a housing 16. A perforated laundry drum 17 is disposed within the housing 16, same being adapted to rotate on axis 18 powered by drive means, not shown, all as known and in accord with the prior art. The laundry drum 17 itself is disposed between a left hand shroud 19 and a right hand shroud 20 that cooperate to keep the hot air within the laundry drum.

The hot air compartment 10 is located in an attic chamber 25 of the dryer, i.e. within the dryer's housing, that attic chamber being defined by the dryer's roof 15, a floor 26, and walls 11–14. The hot air compartment 10 is especially structured to heat new make-up air from outside the dryer, i.e., from the atmosphere, to reheat recirculated warm air which has already been passed through the laundry drum 17, and to admix and reintroduce that combined hot air mixture into the drum through port 27 in the attic chamber's floor 26. After the hot air has passed through the laundry drum (in accord with the direction arrows 28), same passes into an outlet duct 29 and through lint screen 29A. The outlet duct 29 includes a blower fan 30 powered by a motor, not shown. The blower fan 30 is operated to draw or suck the hot air through the dryer drum 17, and to exhaust same through intermediate duct 31 into exhaust duct 32. The exhaust duct 32 extends vertically upward from adjacent the bottom of the dryer's housing 16, and connects with a stack 33 to atmosphere and a recirculated air duct 34 adjacent the roof 15 of the dryer's housing. A damper 35 is provided in the stack 33 to atmosphere so as to regulate recirculation, into recirculated air duct 34, of the desired portion of the warm exhaust air which has been passed through the dryer's drum 17. Note that the recirculated air duct 34 connects with the roof 15 of the dryer's housing 16, and recirculates the warm exhaust air freely back into the attic chamber 25 (through recirculation port 36) within which the hot air compartment 10 of this invention is positioned. Hence, by means of the duct 29, 31–34 structure a portion of the warm air exhausted from the dryer's drum 17 through exhaust port 37 is reintroduced into the attic chamber 25, see directional arrows 38, 39 indicating that air flow path for the warm exhaust air.

New make-up air must also be introduced into the attic chamber 25 for combining with the recirculated warm air, see directional arrows 40, 41 indicating that air flow path for the make-up air. The make-up air is introduced into the attic chamber 25 through ports 42 in opposed side walls 12, 13 of the dryer's housing 16. The ports 42 are covered by side shroud plates 43 that extend downwardly from adjacent the top of the dryer's housing 16 to adjacent the bottom of the dryer's housing, and are fixed to side walls 12, 13 respectively. The make-up air 41 is thus drawn upwardly along the sides 12, 13 of the dryer's housing so as to preheat that make-up air prior to introducing same into the hot air compartment 10. Likewise, make-up air is introduced into the attic chamber 25 from the rear wall 14 of the dryer's housing 16 as well, same being introduced through an elongated port 44 in the rear wall of the housing as guided by rear shroud plate 45 fixed to that rear wall, see FIG. 2. The rear shroud plate 45 also may extend down to approximately the same level as the side shroud plates 43, all for the purpose of preheating the make-up air prior to passing same into the hot air compartment 10. The make-up air introduced through the back port 44 passes into the attic chamber 25 beneath the ported baffle plate 46, see directional arrows 22. Flow of make-up air 22 from port 44 admixes with make-up air 41 from ports 42.

Note particularly that the attic chamber 25 of the dryer's housing 16 is divided into an upper or recirculated air portion 25*a*, and a lower or make-up air portion 25*b*, by sub-floor 47. The sub-floor 47 is fixed in place between the dryer housing's walls 11–14, thereby preventing access of recirculated air 39, into the attic chamber's lower portion 25*b* and preventing access of make-up air 41, 22 into the attic chamber's upper portion 25*a*.

The hot air compartment 10 is located partially above and partially below the attic chamber's sub-floor 47. The exterior of hot air compartment 10 is defined by floor 51, side walls 52, 53, rear wall 54, front wall 55 and roof 56. The hot air compartment 10 includes inlet port 57 for the recirculated air, inlet port 58 for the make-up air, and outlet port 59 for the admixed recirculated and make-up air. The hot air compartment also includes a heat transfer air duct 71 for the recirculated air, that duct being defined by second wall or roof 56 and side 52, front 55, and rear 54 walls, and by first wall or interior roof 61. The hot air compartment 10 also includes a heat transfer chamber 60 therewithin for the make-up air, same being defined by floor 51 and side 52, front 55 and rear 54 walls of the compartment 10, and by interior roof 61 and interior side wall 62. The hot air compartment's outlet port 59 is defined by the compartment's feed duct 63 which is structured by walls 53–55 and 62. The heat transfer chamber 60 includes heat transfer means mounted therein, that heat transfer means being shown as gas burners 64 having flames 65 for purposes of illustration. The heat transfer chamber's outlet 66 is defined by an elongated port 66 along the ridge pole line thereof, that outlet port 66 opening into the heat transfer air duct 71.

Note particularly that, in this construction of the hot air compartment 10, compartment's roof 56 is disposed directly above the heat transfer chamber 60, that roof 56 covering and being spaced slightly above the roof 61 of that chamber 60, and that roof being connected to that chamber through common front 55 and rear 54 walls. Note also that the compartment's roof is horizontally disposed, and is oriented to underlie the recirculation air port 36 in the dryer housing's roof 15. Because of this orientation and location of the compartment's roof relative to inlet port 57 in that compartment 10 for the recirculated air 39, the recirculated air is first directed onto exterior surface 56*a* of the compartment's roof, and flows also against the exterior surfaces of side wall 53, and front 55 and rear 54 walls, i.e., against the exterior surfaces of the heat transfer air duct 71. Thereafter, the recirculated air 39 is directed into the heat transfer air duct 71 through inlet port 57, and i.e., between the compartment roof's, undersurface 56*b* and the top surface 61*a* of the heat transfer chamber's roof 61, thereby providing two passes in the form of an exterior and then an interior pass for the recirculated air 39 against and through the heat transfer air duct 71. The heat transfer air duct 71 thereby functions as a heat transfer device, that heat transfer device being heated by reason of its proximity to and common structural characteristics with the heat transfer chamber 60.

In use, and as illustrated in the Figures, make-up air 40, 22 from exterior of the dryer's housing 16 is introduced into the dryer's lower attic chamber 25*b* from along both side walls 12, 13 as well as the rear wall 14, of the dryer's housing. This make-up air is preheated to an extent, prior to reaching the hot air compartment 10, as the side walls 12, 13 and rear wall 14 of the dryer's housing 16 are generally warmer than the atmospheric environment. The make-up air is directed up along those housing walls 12–14 due to side shrouds 43 and back shroud 45. This make-up air is then introduced into the heat transfer chamber 60 through inlet port 58 where same is heated by the flames 65 of gas burners 64 to an elevated temperature level.

Recirculated warm air 39 which has already passed through the dryer's drum, is introduced into the upper portion 25*a* of the attic chamber 25 through recirculation duct 34, that duct discharging the recirculated air onto the heated roof 56 of heat transfer air duct 71. The heated heat transfer air duct 71 is disposed above the heat transfer chamber 60 for the gas burners 64 so that same is heated by the hot walls 54, 55 and roof 61 of the heat transfer chamber 60. The recirculated air 39 flows over the top of the heat transfer air duct's roof 56, and around to the sides 54, 55 thereof where same enters into the hot air compartment 10 through port 57. Thereafter, the recirculated air 39 flows underneath hot roof 56 and over hot roof 61, thereby providing two passes for the recirculated air over and through the heat transfer air duct 71 to reheat same.

The make-up air 41, 22 which has been heated to an elevated temperature level by the gas flames 65, is directed through outlet 66 in the heat transfer chamber's roof 61, into the stream of the heated recirculated air 39 flowing through the heat transfer air duct 71. Admixture of the heated recirculated air, and the hot make-up air, occurs within duct 71 of the hot air compartment 10, which opens into the drum 17 of the dryer through port 59.

In connection with this novel laundry dryer structure, note that the make-up or fresh air is preheated prior to passing through the hot air compartment 10, same being preheated by being passed upwardly along the side 12, 13 and rear walls 14 of the dryer's housing 16. Some preheating also occurs when the make-up air passes over floor 26. This preheating of the fresh or make-up air also serves to cool the dryer's sides and rear wall, such cool side walls and rear wall being useful during installation of adjacent dryer equipment. Further, note that the recirculated air is passed twice over the surfaces of the heat transfer air duct 71, i.e., the recirculated air does not pass through the heat transfer chamber 60. Such avoids introduction of lint (which may be present to some degree in the recirculated air) into the heat transfer chamber 60. Further, and by mixing the recirculated air with the make-up air after same have been heated to an elevated temperature, same efficiently transfers heat generated by the gas flames 65 to the recirculated air as well as the fresh make-up air.

Figure 3:
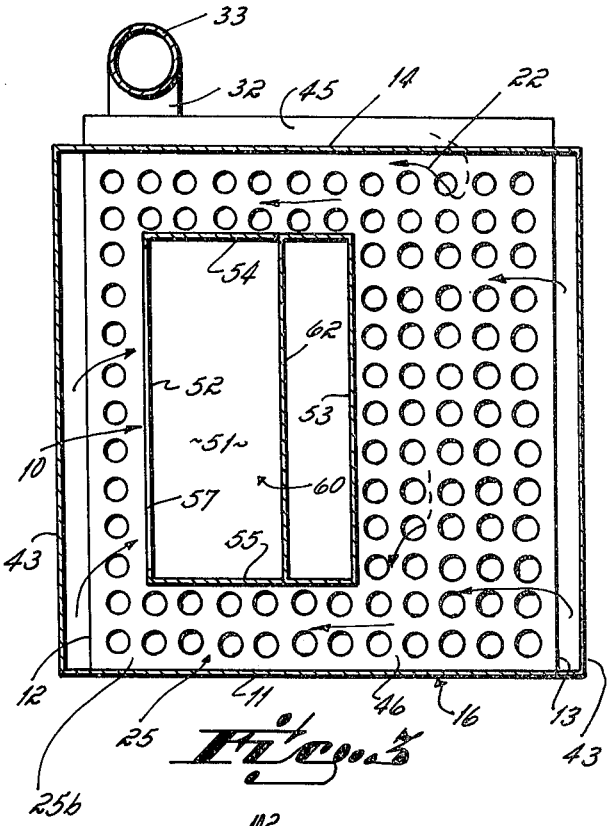
FIG. 3 is a cross-sectional view taken along line 3—3 of FIG. 1.
Figure 4:
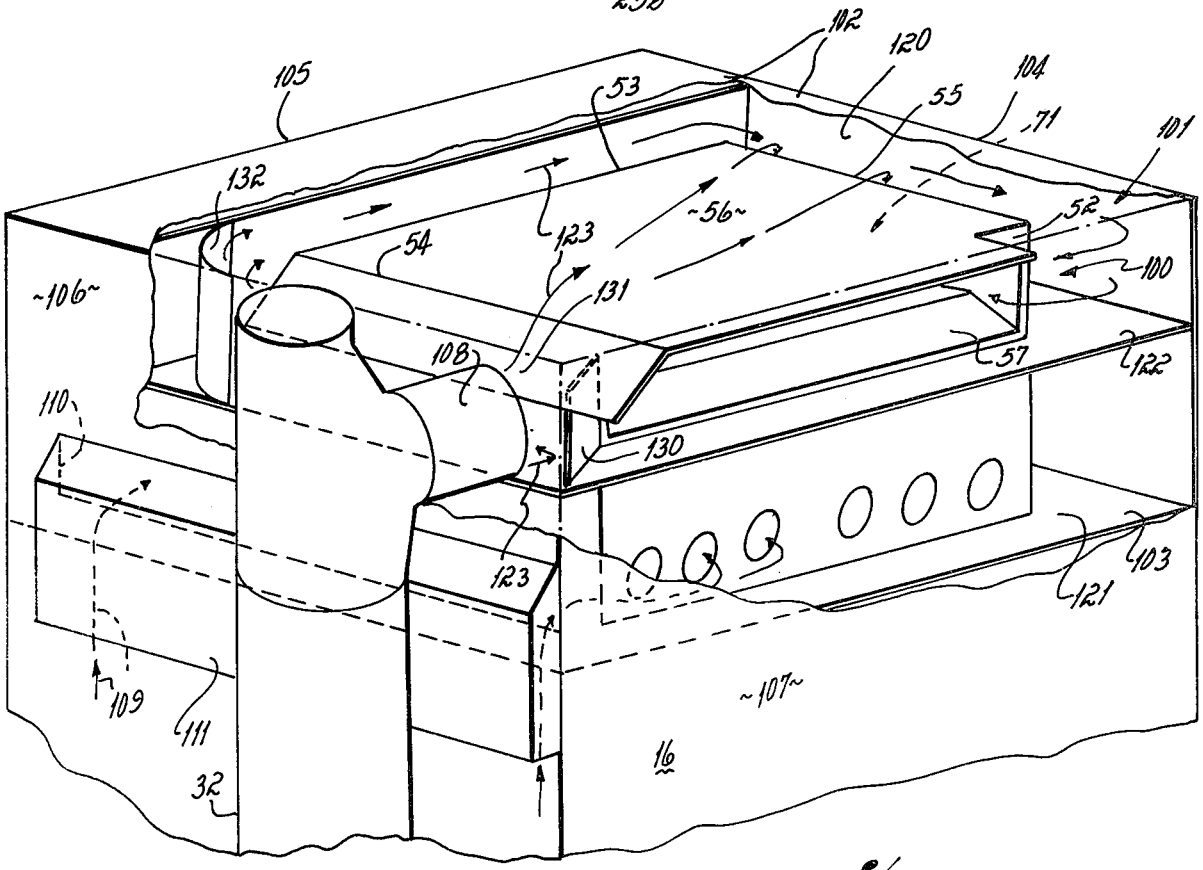
FIG. 4 is a perspective view of an alternative embodiment of a laundry dryer structured in accord with the principles of this invention.

A laundry dryer incorporating an alternative hot air compartment, also in accord with the principles of this invention, is illustrated in FIG. 4, only the top portion of the laundry dryer being illustrated in that figure. The hot air compartment 100 is located in the attic chamber 101 of the dryer, that attic chamber being defined by the dryer's roof 102, an attic floor 103 and walls 104–107. The exhaust duct 32 extends vertically upward from adjacent the bottom (not shown) of the dryer's housing 16, and is adapted to interconnect with a stack (not shown) to the atmosphere. Recirculation air duct 108 also connects with the exhaust duct 32 at one end, and connects with the rear wall 106 of attic chamber 101 at the other end. New make-up air (see directional arrows 109) is introduced into the attic chamber 101 through port 110 extending along the breadth of the dryer housing's rear wall 106, that port being closed to view by a shroud plate 111. The attic chamber 101 of the dryer's housing 16 is divided into an upper or recirculated air portion 120, and a lower or make-up air portion 121, by sub-floor 122. The sub-floor 122 is fixed in place between the dryer housing's walls 104–107, thereby preventing access of recirculated air 123, into the attic chamber's lower portion 121 and preventing access of make-up air 109 into the attic chamber's upper portion 120. The hot air compartment 100 itself is structured identical to the hot air compartment 10 illustrated in FIGS. 1–3.

Figure 2:
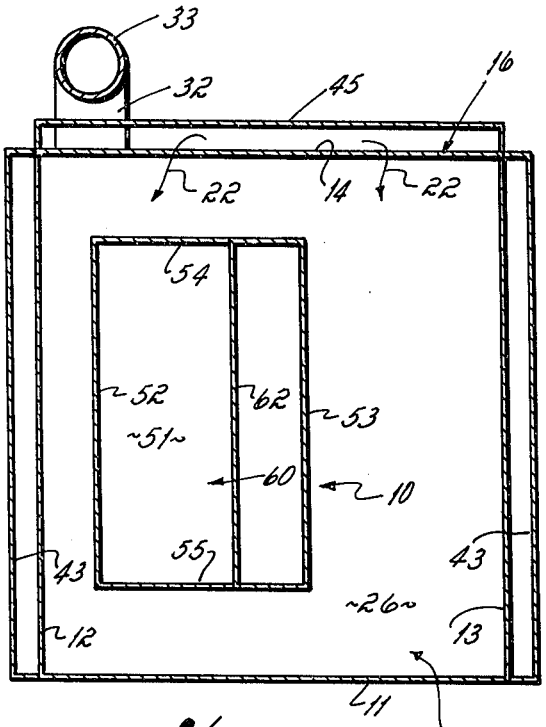
FIG. 2 is a cross-sectional view taken along line 2—2 of FIG. 1.

The primary difference between that embodiment illustrated in FIGS. 1–3, and that embodiment illustrated in FIG. 4, is in the way the recirculated air 123 is introduced into the attic chamber's upper portion 120. Note in the first embodiment, and as illustrated in FIG. 1, that the recirculated air 39 is introduced through recirculated air duct 34 directly down onto the top or exterior surface of the heat transfer air duct's roof 56. In the alternative embodiment, and as illustrated in FIG. 4, the recirculated air 123 is introduced through recirculated air duct 108 in the rear wall 106 of the dryer's housing 16 against rear wall 54 of the hot air compartment 100 in the attic chamber's upper portion 120. A first baffle 130 is provided at the adjacent corner of the heat transfer air duct's inlet port 57 and a second baffle 131 is positioned to extend forwardly from roof 56 over the inlet port 57 of the heat transfer air duct 71, to prevent recirculated air 123 from passing directly into that inlet port 57 from the recirculated air duct 108, i.e., directly into the heat transfer air duct 71. These baffles 130, 131 insure that the recirculated air will pass around the rear 54, side 53 and front 55 walls, as well as over the roof 56 of the heat transfer air duct 71 prior to being introduced into the inlet port 57, i.e., into the interior of the heat transfer air duct. In other words, the baffles 130, 131 insure that the recirculated air 123 passes over the exterior surface of the heat transfer air duct 71 prior to being introduced against the interior surfaces of the heat transfer air duct. Curved baffle 132 in the attic upper portion's rear corner also serves to accommodate the air flow in this regard. Thus, in the case of the FIG. 1–3 embodiment, the recirculated air 39 is directed vertically downwardly against the exterior surfaces of the heat transfer air duct 71 through the roof 15 of the dryer's housing 16, and in the FIG. 4 embodiment the recirculated air 123 is directed horizontally inwardly against the exterior surfaces of the heat transfer air duct 71 through the rear wall of the dryer's housing.

Having described in detail the preferred embodiment of my invention, what I desire to claim and protect by Letters Patent is:

1. A laundry dryer having a hot air compartment structure that heats recirculated exhaust air and fresh make-up air, said hot air compartment structure comprising a heat transfer chamber positioned within an attic chamber for said laundry dryer, said heat transfer chamber including a heat source provided to heat fresh make-up air to an elevated temperature level, said heat transfer chamber also including a roof having an exhaust port therein, the make-up air heated in said heat transfer chamber exhausting from said port in that chamber's roof, make-up air duct structure connected with an inlet port to said heat transfer chamber, said make-up air duct structure directing only fresh make-up air from the atomsphere into said heat transfer chamber, a sub-floor in said attic chamber, said sub-floor being connected with said heat transfer chamber and said attic chamber to form a recirculated air portion of said attic chamber, a heat transfer air duct located above said heat transfer chamber, said heat transfer air duct including an inlet port that communicates with said attic chamber's recirculated air portion, said heat transfer chamber's roof defining a first wall portion thereof, a second wall portion thereof being located within said attic chamber's recirculated air portion and said second wall portion of said heat transfer air duct being positioned above and spaced from said first wall portion of said heat transfer air duct, heated make-up air being exhausted from said heat transfer chamber into said heat transfer air duct through said exhaust port in said heat transfer chamber's roof, a recirculated exhaust air duct connected with said attic chamber's recirculated air portion, recirculated exhaust air from said recirculated exhaust air duct being introduced into said attic chamber's recirculated air portion contacting said heat transfer air duct's second wall portion prior to that recirculated air passing into said heat transfer air duct through said heat transfer air duct's inlet port, and a single feed duct connected at one end with said heat transfer air duct, said feed duct connected at the other end with a shroud for said dryer's drum, said feed duct receiving the recirculated air flow and the make-up air flow after each has been heated, and said air flows being admixed in said feed duct prior to introduction into the dryer's drum.

2. A laundry dryer as set forth in claim 1, including a floor for said attic chamber, said floor being connected with said heat transfer chamber, said subfloor and said attic chamber to form a make-up air portion of said attic chamber, the fresh make-up air being received into said attic chamber's make-up air portion prior to passing through said heat transfer chamber's inlet port.

3. A laundry dryer as set forth in claim 2, said attic chamber being defined by side walls and a roof, said attic chamber's side walls and roof also partially defining said dryer's housing.

4. A laundry dryer as set forth in claim 1, said make-up air duct including inner and outer walls with the inner wall thereof being in heat transfer relation to said drum to heat said inner wall, and thereby preheat said make-up air prior to entry of said make-up air into said heat transfer chamber.

5. A laundry dryer as set forth in claim 1 wherein said heat source includes at least one gas burner.

* * * * *